US008087745B2

(12) United States Patent
Sakurai

(10) Patent No.: US 8,087,745 B2
(45) Date of Patent: Jan. 3, 2012

(54) IMAGE FORMING APPARATUS AND METHOD OF DISCHARGING INK FROM RECORDING HEAD

(75) Inventor: Hisaki Sakurai, Aichi-ken (JP)

(73) Assignee: Brother Kogyo Kabushiki kaisha, Aichi-Ken (JP)

( * ) Notice: Subject to any disclaimer, the term of this patent is extended or adjusted under 35 U.S.C. 154(b) by 1158 days.

(21) Appl. No.: 11/789,048

(22) Filed: Apr. 23, 2007

(65) Prior Publication Data

US 2007/0247486 A1 Oct. 25, 2007

(30) Foreign Application Priority Data

Apr. 24, 2006 (JP) ..... 2006-118766

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS

| | | | | |
|---|---|---|---|---|
| 5,504,508 | A * | 4/1996 | Hashimoto | 347/24 |
| 6,494,560 | B1 * | 12/2002 | Seshimo et al. | 347/23 |
| 6,565,186 | B1 * | 5/2003 | Hattori et al. | 347/24 |
| 2002/0113845 | A1 | 8/2002 | Yazawa et al. | |
| 2005/0057603 | A1 | 3/2005 | Hirakata et al. | |
| 2005/0168508 | A1 * | 8/2005 | Hilton et al. | 347/17 |
| 2005/0174382 | A1 * | 8/2005 | Yoshikawa et al. | 347/30 |

FOREIGN PATENT DOCUMENTS

| | | |
|---|---|---|
| JP | 2691547 | 12/1997 |
| JP | 10181040 | 7/1998 |
| JP | 11091140 | 4/1999 |
| JP | 2004-249631 | 9/2004 |
| JP | 2004/249631 | 9/2004 |
| JP | 2005/035117 | 2/2005 |
| JP | 2005-219419 | 8/2005 |
| JP | 2005-271377 | 10/2005 |
| JP | 3728253 | 12/2005 |

* cited by examiner

*Primary Examiner* — Matthew Luu
*Assistant Examiner* — Alejandro Valencia
(74) *Attorney, Agent, or Firm* — Frommer Lawrence & Haug LLP

(57) ABSTRACT

An image forming apparatus includes a recording head in which a plurality of nozzle groups is formed; a waste-liquid discharging mechanism which includes a plurality of suction caps covering the nozzle groups respectively, a suction mechanism the ink through the suction caps, a plurality of first channels communicating with the suction caps respectively, and a second channel communicating commonly with the first ink channel and with the suction mechanism; and an ink flow-rate control mechanism which control a flow rate of the ink flowing in first channels. Since the image forming apparatus has the ink flow-rate control mechanism, it is capable of sucking evenly the ink from the nozzle groups, irrespective of a shape of the suction cap, and a diameter and a length of the first channels.

13 Claims, 8 Drawing Sheets

IMAGE FORMING APPARATUS AND METHOD OF DISCHARGING INK FROM RECORDING HEAD

CROSS REFERENCE TO RELATED APPLICATION

The present application claims priority from Japanese Patent Application No. 2006-118766 filed on Apr. 24, 2006, the disclosure of which is incorporated herein by reference in its entirety.

BACKGROUND OF THE INVENTION

1. Field of the Invention

The present invention relates to an image forming apparatus which includes a waste-liquid discharging mechanism which facilitates functional recovery by discharging an ink from nozzles formed in a recording head, and a method of discharging ink from the recording head.

2. Description of the Related Art

In an image forming apparatus of an ink-jet recording type, a recording of characters and/or images is performed by making liquid droplets of ink fly toward a recording medium such as a plain paper, thereby making the ink adhere to a surface of the recording medium. After the ink is supplied from an ink cartridge in which the ink is stored, to a recording head, the ink is jetted as fine droplets from a plurality of nozzle groups which are formed in a nozzle surface of the recording head. Accordingly, when there is a defect in ink jetting due to drying of the ink at an opening of each nozzle, blocking due to adhering of dust, and/or an air bubble which has entered the nozzle, it leads to a decline of an image quality.

Therefore, a recovery operation for a function of the recording head is carried out by discharging the ink periodically from the nozzle by a waste-liquid discharging mechanism which is provided on one portion inside a main-body case for eliminating such factors causing the defect in ink jetting.

This waste-liquid discharging mechanism includes a plurality of suction caps which are provided for each of the nozzle groups, and which cover nozzles in each of the nozzle groups by making a contact with a nozzle surface of the recording head, a common suction-force generating mechanism which generates a suction force in these suction caps, and an ink discharge channel which connects the suction caps and the suction-force generating mechanism. The ink discharge passage includes a plurality of first channels, one end of which communicates with each of the suction caps, and a second channel which joins the other ends of the first channels and communicates with the suction-force generating mechanism.

The suction caps are brought into contact with the nozzle surface of the recording head, and the each nozzle group is covered by respective suction cap, and the suction force is generated in the suction cap. By generating the suction force in the suction cap, the ink is sucked from each of the nozzle groups. The ink sucked in the suction cap by the suction-force generating mechanism is transported to a waste-liquid discharge tank after being gathered in the second channel upon passing through the first channel communicating with each suction cap.

In an image forming apparatus which includes such waste-liquid discharging mechanism, there occurs to be a difference in an amount of ink flowing through the first channels according to a difference in a nozzle diameter, the number of nozzles, and/or a channel resistance of the nozzles. For example, it may occur such phenomena that only ink in a first channel having a low channel resistance and a high ink flow rate flows into the second channel, and ink in a first channel having a high channel resistance and a low ink flow rate is hardly discharged. Therefore, some of the nozzle groups may not be recovered sufficiently and moreover, some defects such as discharging unnecessarily ink may occur.

Therefore, to eliminate such defects, the following image forming apparatus has been proposed. In this image forming apparatus, a substantial suction force is generated in nozzle caps covering a nozzle group in which a resistance acting on the ink flowing through the nozzle (channel resistance) is high due to a small nozzle diameter or a large number of the nozzles, whereas a low suction force is generated in nozzle caps covering a nozzle group in which the channel resistance is low due to a large nozzle diameter etc.

Concretely, a discharge hole of the suction caps covering the nozzle group having a low resistance for the ink flow inside the nozzle of which diameter is large is made small, and a diameter of a tube which forms the first channels is made small. Moreover, a length of a discharge tube of the suction caps covering the nozzle group having a large nozzle diameter are made to be longer than a length of a discharge tube of the suction caps covering the nozzle group having small nozzle diameter (For example, refer to pages 2 and pages 4 to 6, and FIG. 4 of Japanese Patent Application Laid-open No. 2004-249631). In Japanese Patent Application Laid-open No. 2004-249631, two suction caps are considered to be formed integrally.

By adjusting an amount of ink sucked of each of the nozzle groups by changing the suction force in such manner, a difference in time required for the functional recovery of each group is reduced, and the functional recovery of the recording head is facilitated without wasting the ink.

SUMMARY OF THE INVENTION

However, in the image forming apparatus mentioned above, volume of each of the suction caps has to be set separately. Or, a thickness and/or length of a tube connected to the suction cap have/has to be set separately. Therefore, there is a substantial load from a point of view of designing.

Moreover, when a difference in a channel resistance in the nozzle group covered by the suction caps is known in advance, it is possible to cope with the abovementioned measures. However, for example, when a shape of the suction caps is the same, the number and diameter of nozzles covered by each suction cap are same, and further, a diameter and a length of the discharge tube are same, it is attributable to a difference in a channel resistance of the discharge tube which is generated due to a manufacturing error of a fine discharge tube, and it is not possible to cope with a difference in an ink flow rate inside the tube.

An object of the present invention is to provide an image forming apparatus which is capable of sucking evenly the ink from the nozzle group covered by the suction nozzles, irrespective of a shape of the suction cap, a diameter and/or a length of a first channel, and a method of discharging ink from a recording head.

According to a first aspect of the present invention, there is provided an image forming apparatus which forms an image by jetting an ink toward a medium, including a recording head in which a plurality of nozzle groups each including a plurality of nozzles is formed;

a waste-liquid discharging mechanism which includes a plurality of suction caps being contactable with the recording head to cover the nozzle groups respectively, a suction mechanism provided in common to the suction caps and sucking the ink in the nozzles of the recording head through the suction caps, a plurality of first channels communicating with the suction caps respectively, and a second channel communicating with the first channels commonly at one end of the second channel and communicating with the suction mechanism at the other end of the second channel; and an ink flow-rate control mechanism which controls a flow rate of the ink flowing through each of the first channels.

According to the first aspect of the present invention, for example, by setting a channel resistance of the second channel to be higher than a channel resistance of each of the first channels, a flow rate of the second channel is decreased to be lower than a flow rate of each of the first channels. In the image forming apparatus of the present invention, since such ink flow-rate control mechanism which control to suppresses the flow of ink in each of the first channels which is merged with the second channel, it is possible to decrease a difference in the flow rate between the first channels. Since it is possible to decrease the difference in the flow rate in each of the first channels, it is possible to discharge the ink evenly from each of the nozzle groups covered by the suction cap respectively.

In the image forming apparatus of the present invention, the ink flow-rate control mechanism may be the second channel which has a channel resistance higher than a channel resistance of each of the first channels. In this case, since the difference in the flow rate between each of the first channels is decreased by increasing the channel resistance of the second channel to be higher than the channel resistance of each of the first channels, it is possible to discharge the ink evenly from each of the nozzle groups covered by the suction cap, irrespective of a manufacturing error of the suction cap and a degree of deformation, a pressure exerted when the recording head is brought into contact, and a manufacturing error in (parameters such as) an inner diameter and a length of a member such as a tube which forms each of the first channels, and it is possible to reduce a load on designing.

In the image forming apparatus of the present invention, the waste-liquid discharging mechanism has a lip portion which entirely covers the nozzle groups; and each of the suction caps is a partition formed inside of the lip portion, and the first channels communicate with the suction caps respectively.

In this case, by using an integrated suction cap which collectively covers the nozzle groups, it is possible to discharge the ink evenly from the nozzle groups covered by each partition of the suction cap (by each divided suction cap).

In the image forming apparatus of the present invention, a total length of the second channel may be longer than a total length of each of the first channels. In this case, it is possible to discharge the ink evenly from each nozzle group of the recording head without complicating a structure. Moreover, the second channel may include a portion of which a cross-sectional area is narrower than a cross-sectional area of each of the first channels. In this case also, it is possible to discharge the ink evenly from each nozzle group of the recording head without complicating the structure. Furthermore, since a change in the length of the second channel is not associated, it is possible to let the waste-liquid discharging mechanism to have a compact structure, and to facilitate a reduction in a size of the image forming apparatus.

In the image forming apparatus of the present invention, the waste-liquid discharging mechanism may include a coupling which communicates each of the first channels with the second channel; and the coupling may includes a second communicating portion which communicates with the second channel and which forms a part of the second channel, and a plurality of first communicating portions each of which communicates one of the first channels independently with the second communicating portion and each of which forms a part of the one of the first channels.

In this case, since each of the first channels and the second channel are connected via the coupling, it is possible to change only one of the first channels or only the second channel independently, and to make easily a change in a structure of the ink discharge passage. Consequently, in the image forming apparatus, it is possible to improve a degree of freedom of a layout of the ink discharge passage.

In the image forming apparatus of the present invention, a length of the second communicating portion of the coupling may be adjusted so as to make a total length of the second channel to be greater than a length of each of the first channels.

In this case, since the length of the second communicating portion of the coupling is adjusted, the total length of the second channel becomes longer than the length of each of the first channels, and it is possible to discharge the ink evenly from each nozzle group of the recording head without complicating the structure.

In the image forming apparatus of the present invention, the second communicating portion of the coupling may include a portion of which a cross-sectional area is narrower than a cross-sectional area of each of the first channels.

In this case, since the portion having the cross-sectional area smaller than (the cross-sectional area) of each of the first channels is provided to the second communicating portion of the coupling, it is possible to increase the channel resistance of the second channel, and to discharge the ink evenly from each nozzle group of the recording head without complicating the structure. Moreover, since the change of the length of the second channel is not associated, it is possible to let the waste-liquid discharging mechanism have a compact structure, and to facilitate the reduction in size of the image forming apparatus.

In the image forming apparatus of the present invention, the ink flow-rate control mechanism may include a buffer tank, a cross-sectional area of the buffer tank being wider than a cross-sectional area of each of the first channels and the buffer tank being provided at a position at which the first channels are merged.

In this case, since the buffer tank is arranged at the position where the first channels are merged, it is possible to store the ink temporarily in the buffer tank, and to decrease the difference in the flow rate between the first channels irrespective of the cross-sectional area of each of the first channels and the second channel, and a frictional resistance between an inner peripheral surface and the ink.

In the image forming apparatus of the present invention, a part of each of the first channels and a part of the second channel may be formed by a flexible tube.

In this case, since a part of the second channel and each of the first channels is formed by the flexible tube, the ink discharge passage is made to follow easily with a movement of each of the suction cap, and it is possible to reduce a load on the ink discharge passage by absorbing vibrations or the like. Moreover, a life of the ink discharge passage becomes longer, and it is possible to eliminate a time and labor of maintenance.

In the image forming apparatus of the present invention, a shape of the cross-section of the second communicating portion of the coupling may be a star shape. Since the cross-sectional shape of the second communicating portion of the coupling is a star shape, it is possible to increase a channel resistance of the second communicating portion, and to discharge the ink evenly from each nozzle group of the recording head.

In the image forming apparatus of the present invention, a projection (protrusion) may be formed on an inner surface of the second channel. Since the projection is formed on the inner surface of the second channel, it is possible to increase the channel resistance of the second channel, and to discharge the ink evenly from each nozzle group of the recording head.

According to a second aspect of the present invention, there is provided a method for discharging an ink from a recording head including a step for covering a plurality of nozzle groups each of which jets the ink and each of which is provided in the recording head, by a plurality of suction caps respectively;

a step for sucking the ink from the nozzle groups through the suction caps into the first channels which are connected for each suction cap by a suction mechanism which communicate with the suction caps commonly; and a step for joining the sucked ink from the first channels into a second channel to discharge therefrom.

The step for sucking is performed while decreasing a flow rate of the ink in the second channel than a flow rate in each of the first channels.

According to the second aspect of the present invention, by decreasing the flow rate of the second channel to be lower than the flow rate of the first channel combined with the second channel, an ink flow in each of the first channels combined with the second channel is suppressed, and it is possible to decrease the difference in the flow rate between the first channels. Therefore, it is possible to discharge the ink evenly from the nozzle groups covered by the suction cap.

DETAILED DESCRIPTION OF THE PREFERRED EMBODIMENTS

Figure 1:
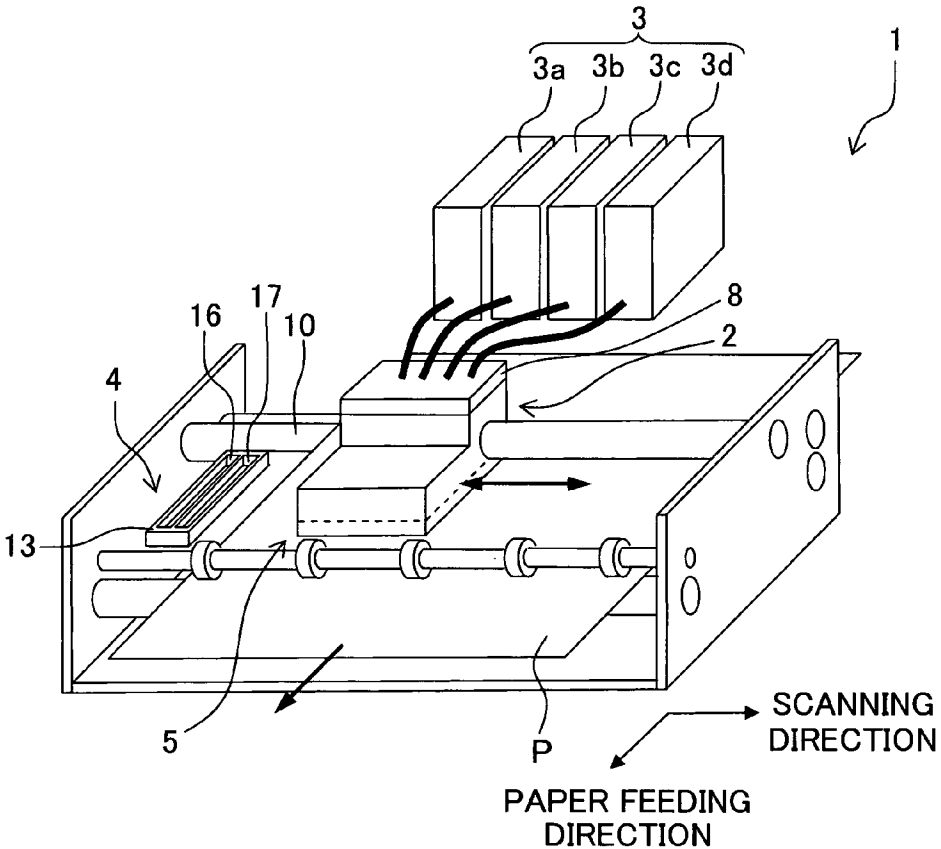
FIG. 1 is a schematic perspective view showing an embodiment of an image forming apparatus according to the present invention.
Figure 2:
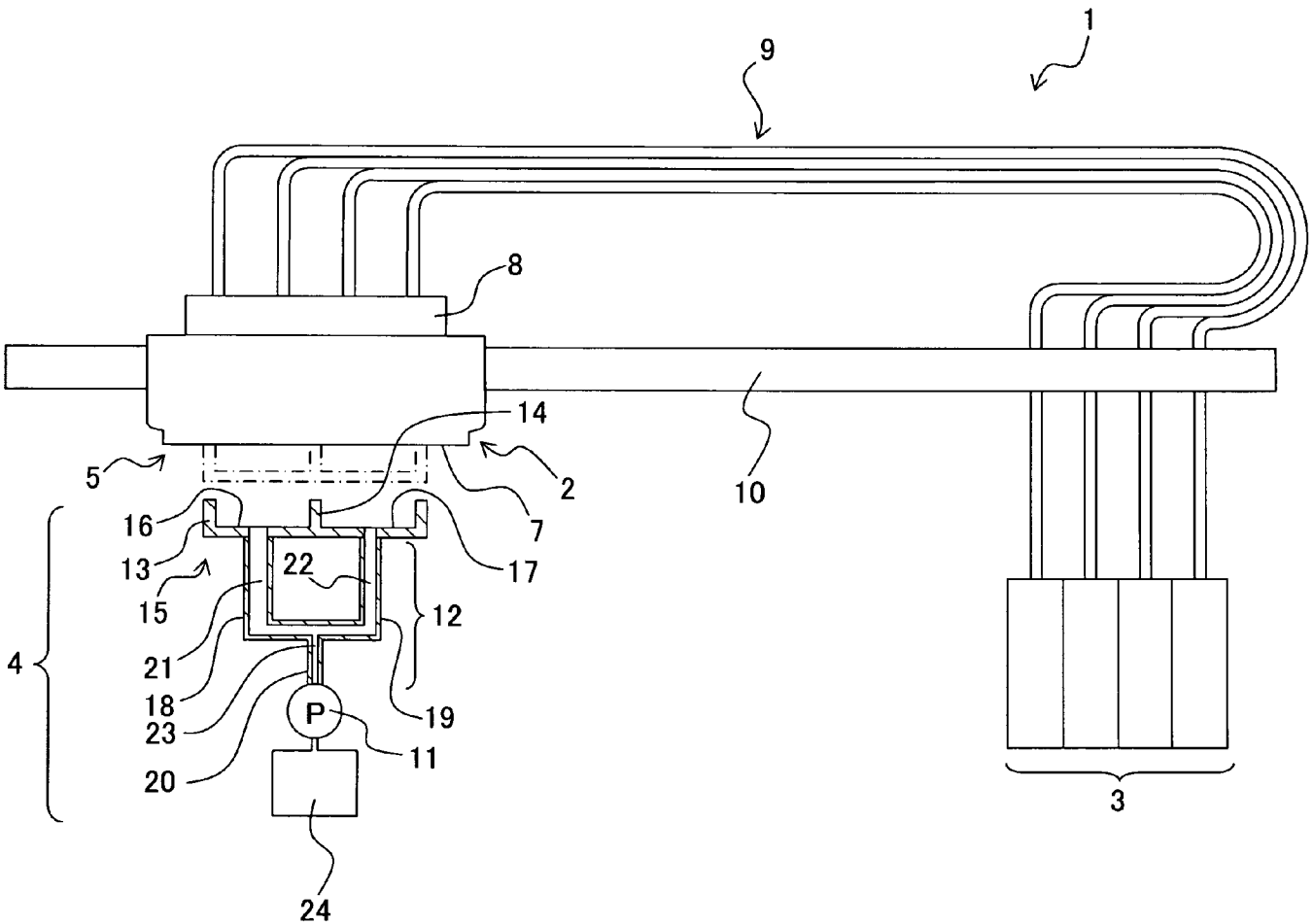
FIG. 2 is a diagram showing the embodiment of the image forming apparatus according to the present invention.

An embodiment of an image forming apparatus and a method of discharging ink of a recording head according to the present invention will be described below with reference to the diagrams. FIG. 1 is a schematic diagram of an image forming apparatus 1 according to the present invention, and FIG. 2 is a diagram of the image forming apparatus 1. The image forming apparatus 1 includes a recording head 5 which performs recording by jetting an ink toward a recording medium, a head holder 2 which also serves as a carriage, an ink cartridge 3 in which inks of plurality of colors are stored, and a waste-liquid discharging mechanism 4 which discharges upon sucking the ink from nozzles formed in the recording head 5.

Figure 3:
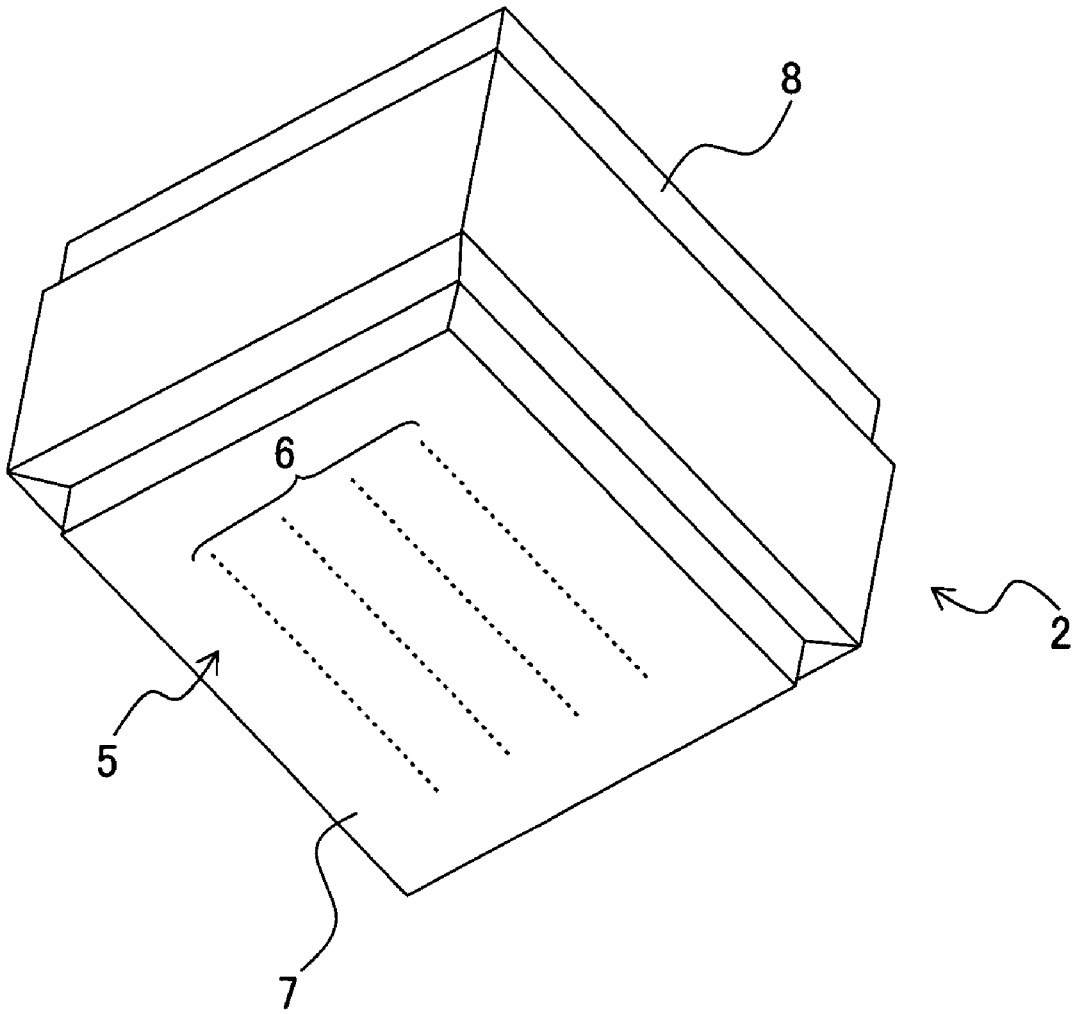
FIG. 3 is a perspective view from a downward-inclined front side, of a head holder according to this embodiment.
Figure 4:
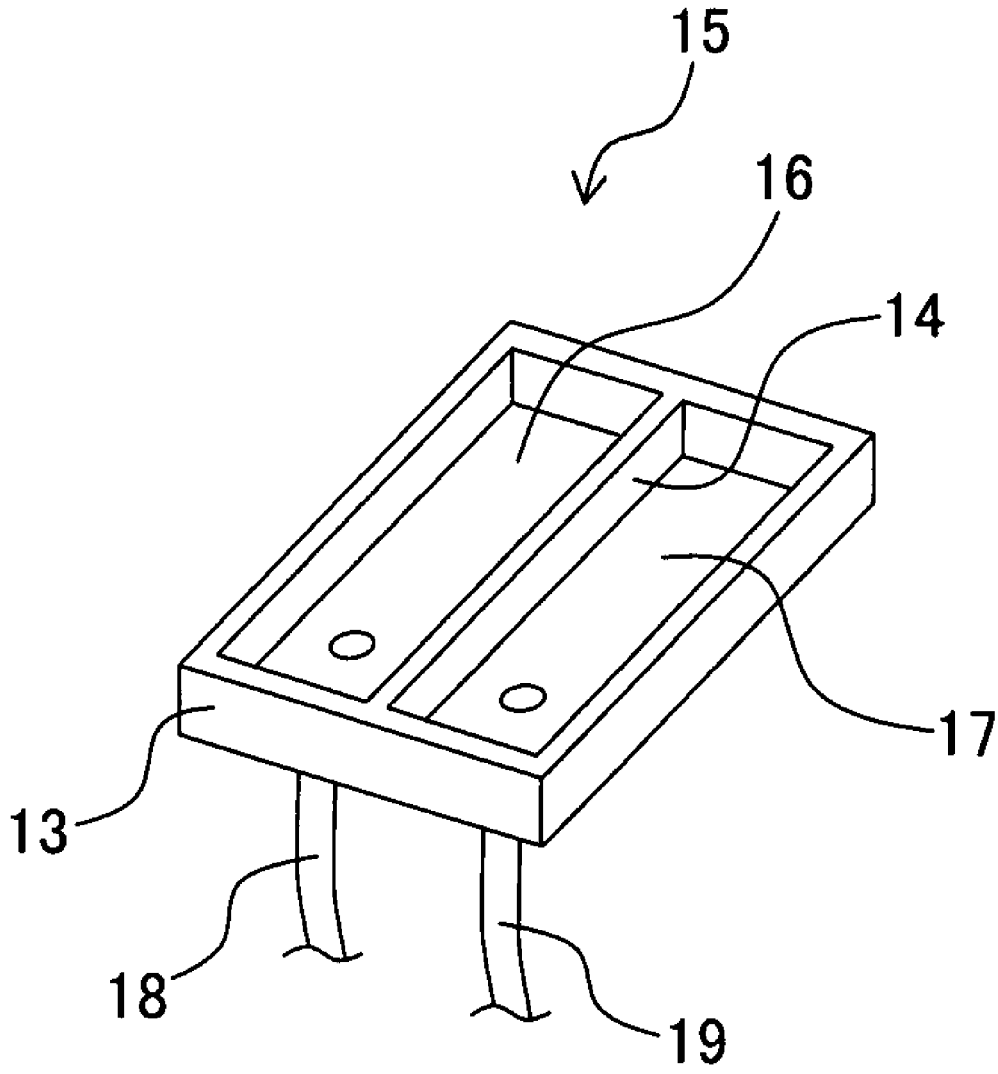
FIG. 4 is a perspective view from an upward-inclined front side, of a suction cap according to this embodiment.

As shown in FIG. 3, the recording head 5 is supported by the head holder 2. A plurality of nozzle rows 6*a* to 6*d* which jet ink, is formed in a bottom surface (nozzle surface 7) of the recording head 5, and inks of different colors are jetted from nozzles 6 in each of the nozzle rows 6*a* to 6*d* respectively. The recording head 5 is arranged on a bottom surface of the head holder with placing the nozzle surface 7, in which these nozzles 6 are formed, down.

A sub-tank 8 which includes a plurality of ink storage chambers corresponding to the inks of plurality of colors, and which absorb a pressure fluctuation is mounted on an upper side of the head holder. Each of the ink storage chambers of this sub-tank 8 communicates with the nozzles 6 in one of the nozzle row of the recording head 5 which jet an ink of the same color, and also communicates with the ink cartridge 3 in which the inks of same colors are stored, via a flexible tube 9.

As shown in FIG. 1, the head holder 2 is movable along a guide 10 which is arranged in a direction (scanning direction) orthogonal to a direction of sending a recording medium P (paper feeding direction). The ink is jetted from the nozzles 6 in the recording head 5 of the head holder while moving the carriage along a surface of the recording medium P. Accordingly, droplets of ink are adhered on the surface of the recording medium P, and characters and images are recorded on the recording medium P by making such arrangement.

The waste-liquid discharging mechanism 4 includes two suction caps 16 and 17 which are in contact with the recording head 5, a pump (suction-force generating mechanism, suction mechanism) 11 which is provided in common to the suction caps 16 and 17, and which generates a suction force inside the suction caps 16 and 17, and an ink discharge passage 12 which communicates the suctions caps 16 and 17 with the suction-force generating mechanism 11. Since the waste-liquid discharging mechanism 4 has two suction caps, it is possible to cover separately the nozzles 6 included in each of these nozzle groups, by dividing the nozzle groups into two nozzle groups according to a color and/or a drying property of ink discharged from the ink. For example, it is possible to divide the nozzle rows including the nozzles 6 respectively, into two nozzle groups including the same number of nozzles respectively.

As shown in FIG. 3, the two suction caps 16 and 17 are formed by demarcating an outer peripheral lip portion (a second lip portion) 13 of an integrated suction cap 15 which is capable of collectively covering the two nozzle groups, by a partition wall 14 into two such that the two portions have almost the same volume. These two suction caps 16 and 17 (two demarcated portions formed in the integrated suction cap 15) cover these two nozzle groups separately.

The ink discharge passage 12 includes two first tubes 18 and 19, and one second tube 20. A shape of a cross-section of these tubes is substantially circular. Inside of the first tubes 18 and 19 are ink channels (first channels 21 and 22), and an inside of the second tube 20 is another ink channel (second channel 23). One end of each of the first tubes 18 and 19 is connected to the integrated suction cap 15. The first channels 21 and 22 inside the first tubes 18 and 19 communicate respectively with the two suction caps (two partitions) 16 and 17 of the integrated suction cap 15.

Moreover, the other end of the first tubes 18 and 19 are connected integrally to one end of the second tube 20. In other words, the first channels 21 and 22 of the first tubes 18 and 19 merge with the second channel 23 inside the second tube 20. Moreover, the other end of the second tube 20 is connected to the suction-force generating mechanism 11. The first channels 21 and 22 of the first tube 18 and 19 communicate with the suction-force generating mechanism 11 through the second channel 23.

Flexible tubes are used for these first tubes 18 and 19, and the second tube 20. The first tubes 18 and 19 have the same length. An inner diameter of the first tube 18 is slightly larger than an inner diameter of the first tube 19, and an inner diameter of the second tube 20 is even smaller than the inner diameter of the first tube 19. Consequently, a channel resistance of the first channel 21 is the lowest, and a channel resistance of the second channel 23 is the highest. The second tube 20 corresponds to an ink flow-rate control mechanism (an ink flow-rate adjusting mechanism) in this patent application. Moreover, the channel resistance of the second channel 23 may be increased to be higher than the channel resistance of the first channels 21 and 22 by forming the second channel 23 which is longer than the first channels 21 and 22.

The suction-force generating mechanism 11 is a mechanism which generates a suction force by making an inside of the suction cap 15 to be negatively pressurized, and it is possible to use a suction pump such as a tube pump for example. Moreover, the suction-force generating mechanism 11 communicates with a waste-liquid discharge tank 24 which stores a waste liquid of ink (waste ink), and it is possible to transport the ink discharged from each nozzle 6 to the waste-liquid discharge tank 24.

Figure 8:
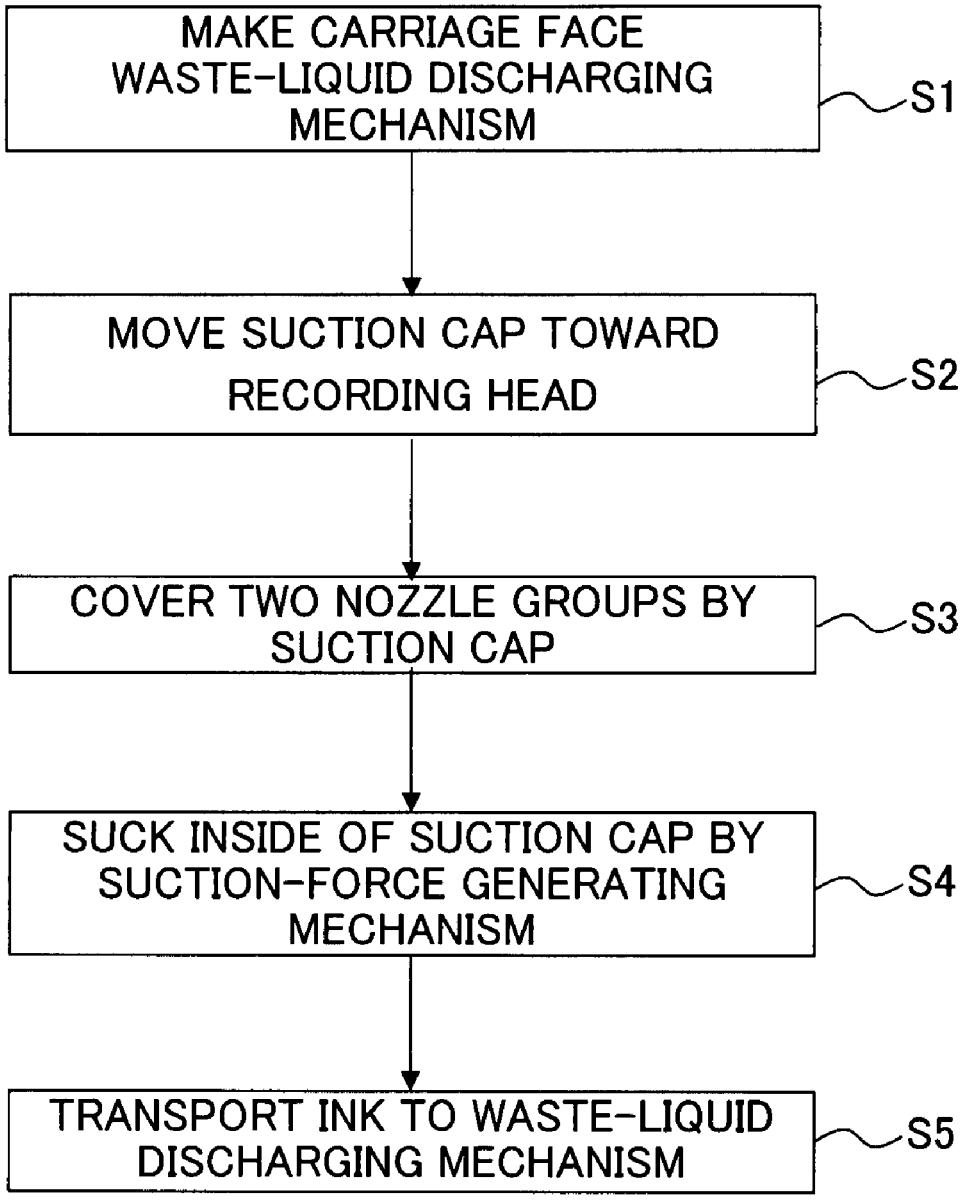
FIG. 8 is a flowchart showing an ink discharge method of the present invention.

Next, a method of discharging the ink from each nozzle 6 of the recording head 5 will be described with reference to FIG. 8. Firstly, the carriage is moved to a position at which the waste-liquid discharging mechanism 4 is arranged, and the recording head 5 and the suction cap 15 are arranged to face mutually (step S1). Next, as shown in FIG. 8, the integrated suction cap 15 is moved toward the recording head 5 (step S2) A front end of the outer peripheral lip portion 13 is made to be in contact with the nozzle surface 7 of the recording head 5, and to cover the two nozzle groups (S3). At this time, one nozzle group is capped by the suction cap 16 and the other nozzle group is capped by the suction cap 17.

The suction-force generating mechanism 11 is driven in this state and air in the suction caps 16 and 17 is sucked through the first channel 20 and the second channel 21 respectively (step S4). Accordingly, the suction force is generated by negatively pressurizing the inside of the suction caps 16 and 17, and the ink is sucked from the nozzles 6 of each nozzle group. The ink which is sucked from the nozzles 6 of the two nozzle groups, and discharged in the suction caps 16 and 17 is collected in the second tube 20 from the first tubes 18 and 19, and is supplied to the waste-liquid discharge tank 24 via the suction-force generating mechanism 11 (step S5).

At this time, the second channel 23 in the second tube 20 has the channel resistance higher than the channel resistance of the first channels 21 and 22 of the first tubes 18 and 19 respectively, and has a flow-rate lower than a flow-rate of the first channels 21 and 22 of the first tubes 18 and 19 respectively. Therefore, the ink flow is suppressed even in the first channels 21 and 22 which combine with the second channel 23, and a difference in the flow rate in these channels is decreased. Accordingly, the flow rate of the ink in the first channels 21 and 22 is equalized, and the ink discharged to the two suction caps 16 and 17 is discharged evenly.

In this manner, it is possible to make even the flow rate of the ink flowing through these channels by increasing the channel resistance of the second channel to be higher than the channel resistance of both the first channels. Consequently, it is possible to discharge evenly the ink which is discharged to each suction cap, irrespective of the cross-sectional area and length of the first channel, the size of the suction cap (size of demarcation (are a demarcated) formed by the integrated suction cap) and/or the diameter and the, number of nozzles covered by each suction cap.

Consequently, there is no possibility that a small (minute) manufacturing error of the tube has an effect on a suction performance (capability) of ink of the suction cap, even when the first tubes are formed by a tube having the same inner diameter and the same length.

Modified embodiments of the image forming apparatus according to the present invention will be described below with reference to FIGS. 5A to 7. Same reference numerals are used for components showing the same components in FIG. 1, and description of such components is omitted.

Figure 5A:
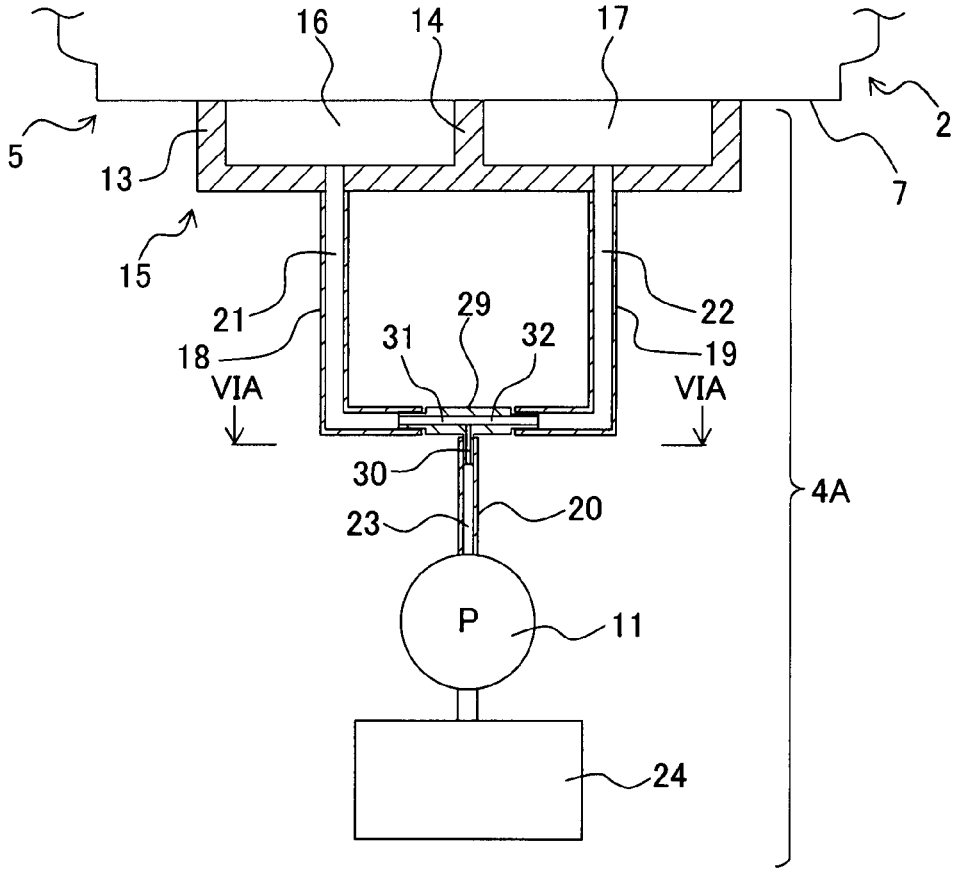
FIG. 5A is a diagram of an area around an ink discharge channel in a first modified embodiment of the image forming apparatus according to the present invention.
Figure 5B:
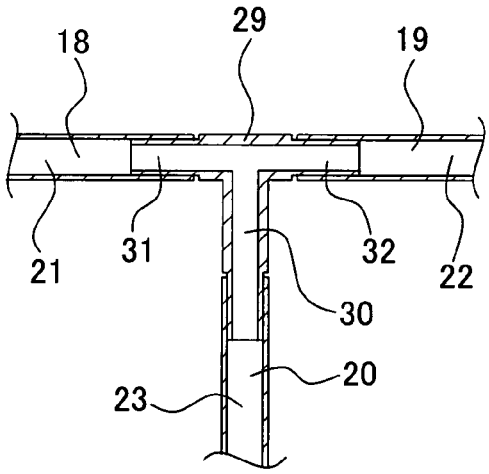
FIG. 5B is a diagram of an ink discharge passage in a second modified embodiment of the image forming apparatus according to the present invention.

In a first modified embodiment shown in FIG. 5A, a waste-liquid discharging mechanism 4A includes a coupling 29 which connects the first tubes 18 and 19, and the second tube 20. The coupling 29 has a shape of an English alphabet T, and two first communicating portions 31 and 32 directed toward both sides are formed inside the coupling. Furthermore, a second communicating portion 30 which communicates with the first communicating portions 31 and 32 and which is directed downward is formed inside the coupling 29. By connecting the first tubes 18 and 19, the second tube 20, and the coupling 29, the first channels 21 and 22 of the first tubes 18 and 19 are connected to the first communicating portions 31 and 32 respectively, of the coupling 29, and the second channel 23 of the second tube 20 is connected to the second communicating portion 30 of the coupling 29. Accordingly, the first channels 21 and 22 communicate with the second channel 23 via the first communicating portions 31 and 32, and the second communicating portion 30. In this manner, when the first tubes 18 and 19, and the second tube 20 are connected via the coupling 29, it is possible to change (exchange) independently for each tube. In this modified embodiment, the channel resistance of the second channel 23 including the second communicating portion 30 is higher (more) than the channel resistance of the first channels 21 and 23 including the first communicating portions 31 and 32.

In a second modified embodiment shown in Fig. SB, since the communicating portion 30 which is long is formed in the coupling 29, the channel resistance of the second channel is higher than the channel resistance of the first channels 21 and 22.

Figure 6A:
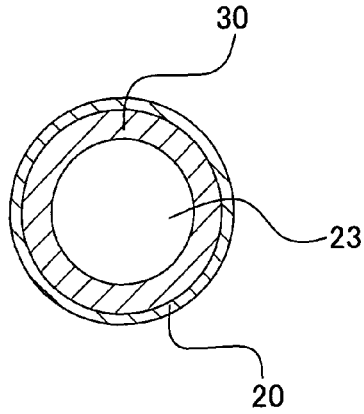
FIG. 6A is a cross-sectional view taken along a line VIA-VIA in FIG. 5A.
Figure 6B:
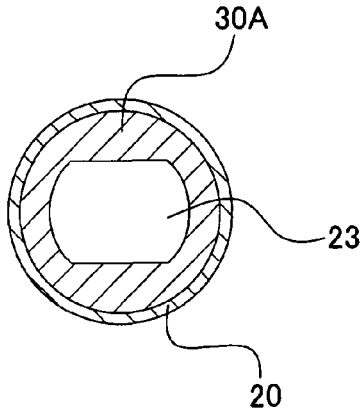
FIG. 6B is a diagram corresponding to FIG. 6A, in a third modified embodiment of the image forming apparatus according to the present invention.

FIG. 6A is a cross-sectional view taken along a line 6A-6A in FIG. 5A. A cross-sectional shape of the second communicating portion 30 shown in FIG. 6A is a ring shape. Whereas, in a third modified embodiment shown in FIG. 6B, a thick wall portion 300 is formed in a portion of a second communicating portion 30A, facing in a vertical direction in FIG. 6B. In other words, the thick wall portion 300 which decreases a gap of a surface facing an inner peripheral surface is formed in the second communicating portion 30A, and a cross-sectional area of the second communicating portion 30A is smaller than a cross-sectional area of the first channels 21 and 22. Since the thick wall portion 300 is formed in the second communicating portion 30A, the channel resistance of the second channel 23 is higher than the channel resistance of the first channels 21 and 22. A shape of such thick wall portion 300 is arbitrary, and the thick wall portion may be formed throughout a longitudinal direction of the second communicating portion 30A, or may be formed in a part thereof.

Figure 6C:
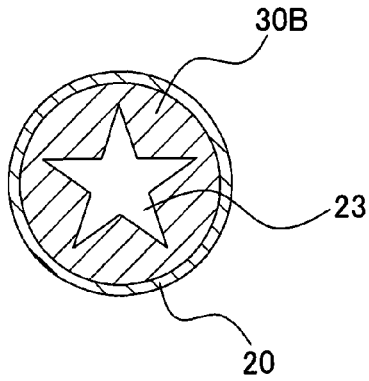
FIG. 6C is a diagram corresponding to FIG. 6A, in a fourth modified embodiment of the image forming apparatus according to the present invention.

In a fourth modified embodiment shown in FIG. 6C, it is possible to increase a frictional resistance between the ink flowing through the second channel 23 and an inner surface of the second communicating portion 30B by making a shape of a cross-section of a second communicating portion 30B to be star shaped. Accordingly, the channel resistance of the second channel 23 is higher than that of the first channels 21 and 22. In this case, the shape of the cross-section of the second communicating portion in not restricted to the star shape, and may be any shape which is capable of increasing the frictional resistance. For example, a plurality of projections (protrusions) or a plurality of folds may be formed on an inner wall of the second communicating portion. In any of the cases, since it is possible to increase an area of an area of an inner surface of the second communicating portion, in contact with the ink, it is possible to increase the frictional resistance between the ink and the inner surface of the second communicating portion. Furthermore, since the projections or the folds formed on the inner surface of the second communicating portion is also capable of playing a role of obstructing the flow of the ink, it is possible to increase the channel resistance of the second channel.

Figure 7:
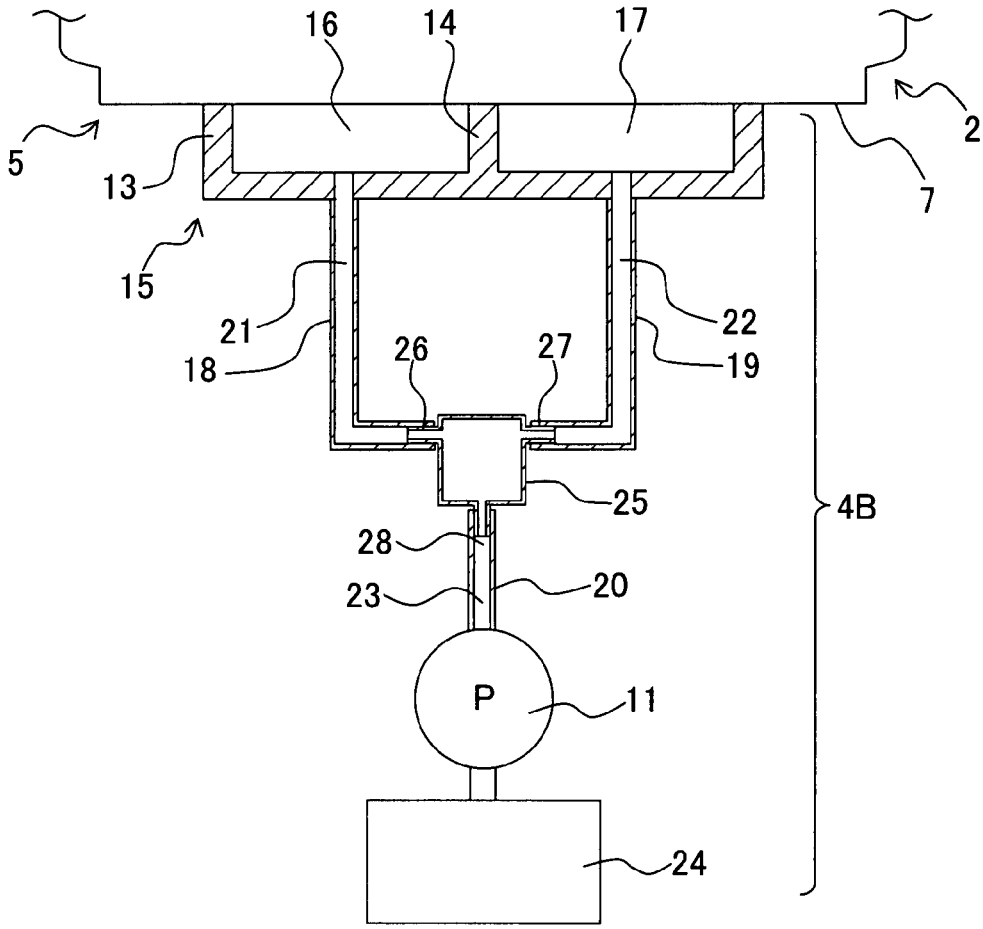
FIG. 7 is a diagram of an area around an ink discharge passage of another image forming apparatus according to the present invention.

A waste-liquid discharging mechanism 4B shown in FIG. 7 includes a buffer tank (ink flow-rate adjusting mechanism, ink flow-rate control mechanism) 25 which connects the first tubes 18 and 19, and the second tube 20, instead of the coupling 29 of the waste-liquid discharging mechanism 4A mentioned above. Connecting portions 26 and 27 to which one end of each of the first tubes 18 and 19 can be fixed are provided on both side surfaces of the buffer tank 25, and a connecting portion 28 to which one end of the first tube 20 can be fixed is provided on a bottom surface of the buffer tank 25.

Since an area of a cross-section of the buffer tank 25, orthogonal to a direction in which the ink flows in from the first tubes 18 and 19 is wider than a cross-sectional area of the first channels 21 and 22, the ink is susceptible to flow in from the first tubes 18 and 19. Moreover, since an area of a cross-section of the buffer tank 25, orthogonal to a direction in which the ink flows out from the second tube is wider than a cross-sectional area of the second channel 23, the ink is stored temporarily in the buffer tank 25. In this case, it is not necessary to have a difference of channel resistance between the first channels 21 and 22, and the second channel 23, but similarly as in the embodiment described above, the channel resistance of the second channel 23 may be let to be higher than the channel resistance of the other channels.

In this manner, by storing the ink temporarily in the buffer tank 25, it is possible to decrease the difference in the flow rate between the two first channels, irrespective of the frictional resistance between the inner peripheral surface and the cross-sectional area of each of the first channels and the second channel, and the ink.

In the embodiment and the modified embodiments described above, the suction cap is integrated. However, a plurality of nozzle groups may be covered by a plurality of suction caps which are formed independently. Moreover, the nozzle rows (or nozzles) maybe divided into three or more groups, and these groups may be covered independently by suction caps. Even in this case, a plurality of suction caps which are independent may be used, or an inside of the integrated suction cap may be divided into three or more portions. Furthermore, it is also possible to provide two or more first channels to each divided portion formed in the integrated suction cap or each independent suction cap.

Moreover, in the embodiment described above, inks of different colors may be supplied to the nozzle rows divided into two groups, or the same ink supplied from one ink cartridge for example may be supplied to the nozzle rows divided into two groups. Even in the latter case, it is possible to prevent the ink of the same color from being sucked in a large quantity from one of the two nozzle rows.

Moreover, the nozzle rows may be divided evenly into two groups. For covering the two groups of nozzle rows divided evenly, even when a size of the two suction caps and/or the cross-sectional area of the first channels differ, by increasing the channel resistance of each of the first channel to be higher than the channel resistance of the second channel, it is possible to apply the present invention. Or, a buffer tank may be provided to a waste-liquid discharging mechanism.

The ink flow-rate control mechanism in the image forming apparatus of the present invention is not restricted to the mechanism as structured in the embodiment. The ink flow-rate control mechanism may be structured arbitrarily provided that it is a mechanism which makes even, the flow rate of the first channel by suppressing the difference in the flow rate of the ink flowing through a plurality of channels.

What is claimed is:

1. An image forming apparatus which forms an image by jetting an ink toward a medium, comprising:

a recording head in which a plurality of nozzle groups, each including a plurality of nozzles, is formed;

a waste-liquid discharging mechanism which includes:

a plurality of suction caps being contactable with the recording head to cover the nozzle groups respectively;

a suction mechanism provided in common to the suction caps and sucking the ink in the nozzles of the recording head through the suction caps;

a plurality of first channels communicating with the suction caps via through holes formed in the suction caps, respectively; and a second channel communicating with the first channels commonly at one end of the second channel and communicating with the suction mechanism at the other end of the second channel; and an ink flow-rate control mechanism which controls a flow rate of the ink flowing through each of the first channels, so that ink flows through the first channels simultaneously, wherein the ink flow-rate control mechanism is the second channel which has a channel resistance higher than a channel resistance of each of the first channels.

2. The image forming apparatus according to claim 1;

wherein the waste-liquid discharging mechanism has a lip portion which entirely covers the nozzle groups; and wherein each of the suction caps is a partition formed inside of the lip portion, and the first channels communicate with the suction caps respectively.

3. The image forming apparatus according to claim 1;

wherein a total length of the second channel is longer than a total length of each of the first channels.

4. The image forming apparatus according to claim 1;

wherein the second channel includes a portion of which a cross-sectional area is narrower than a cross-sectional area of each of the first channels.

5. The image forming apparatus according to claim 1;

wherein the waste-liquid discharging mechanism includes a coupling which communicates each of the first channels with the second channel; and wherein the coupling includes a second communicating portion which communicates with the second channel and which forms a part of the second channel, and a plurality of first communicating portions each of which communicates one of the first channels independently with the second communicating portion and each of which forms a part of the one of the first channels.

6. The image forming apparatus according to claim 5;

wherein a length of the second communicating portion of the coupling is adjusted so as to make a total length of the second channel to be greater than a length of each of the first channels.

7. The image forming apparatus according to claim 5;

wherein the second communicating portion of the coupling includes a portion of which a cross-sectional area is narrower than a cross-sectional area of each of the first channels.

8. The image forming apparatus according to claim 1;

wherein the ink flow-rate control mechanism includes a buffer tank, a cross-sectional area of the buffer tank being wider than a cross-sectional area of each of the first channels and the buffer tank being provided at a position at which the first channels are merged.

9. The image forming apparatus according to claim 1;

wherein a part of each of the first channels and a part of the second channel are formed by a flexible tube.

10. The image forming apparatus according to claim 8;

wherein a part of each of the first channels and a part of the second channel are formed by a flexible tube.

11. The image forming apparatus according to claim 7;

wherein a shape of the cross-section of the second communicating portion of the coupling is a star shape.

12. The image forming apparatus according to claim 1;

wherein a projection is formed on an inner surface of the second channel.

13. A method for discharging an ink from a recording head comprising:

a step for covering a plurality of nozzle groups, each of which jets the ink and each of which is provided in the recording head, by a plurality of suction caps respectively;

a step for sucking the ink from the nozzle groups through the suction caps into a plurality of first channels simultaneously, each of the first channels being connected to one of the suction caps via one of through holes formed in the one of the suction cap by a suction mechanism which communicate with the suction caps commonly; and a step for joining the sucked ink from the first channels into a second channel to discharge therefrom;

wherein the step of sucking is performed while decreasing a flow rate of the ink in the second channel to be less than a flow rate in each of the first channels.

* * * * *